US008353571B2

(12) United States Patent
Kondo

(10) Patent No.: US 8,353,571 B2
(45) Date of Patent: Jan. 15, 2013

(54) LIQUID EJECTING APPARATUS AND METHOD FOR MANUFACTURING LIQUID EJECTING APPARATUS

(75) Inventor: Hirofumi Kondo, Tajimi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 243 days.

(21) Appl. No.: 12/722,032

(22) Filed: Mar. 11, 2010

(65) Prior Publication Data

US 2010/0231627 A1 Sep. 16, 2010

(30) Foreign Application Priority Data

Mar. 11, 2009 (JP) ..... 2009-058177

(51) Int. Cl.

| | |
|---|---|
| ***B41J 29/38*** | (2006.01) |
| ***B41J 29/393*** | (2006.01) |
| ***B41J 2/05*** | (2006.01) |
| ***B41J 2/045*** | (2006.01) |

(52) U.S. Cl. ..... 347/14; 347/19; 347/59; 347/70

(58) Field of Classification Search ..... None
See application file for complete search history.

(56) References Cited

U.S. PATENT DOCUMENTS

2007/0139487 A1* 6/2007 Sekiguchi ..... 347/70
2007/0222822 A1* 9/2007 Ito ..... 347/59

FOREIGN PATENT DOCUMENTS

JP 2007196404 A 8/2007

* cited by examiner

*Primary Examiner* — Stephen Meier
*Assistant Examiner* — Alexander C Witkowski
(74) *Attorney, Agent, or Firm* — Baker Botts L.L.P.

(57) ABSTRACT

A printer apparatus includes a drive circuit and a flexible board on which the drive circuit is mounted. A first input line and a second input line for inputting a driving signal respectively to the drive circuit and an actuator are provided on the flexible board. A thermistor that has a high resistance value with terminals provided therein being in an electrically disconnected state at a temperature not less than a predetermined temperature and has a low resistance value with the terminals being in an electrically connected state at a temperature lower than the predetermined temperature is provided between the first input line and the second input line.

7 Claims, 11 Drawing Sheets

LIQUID EJECTING APPARATUS AND METHOD FOR MANUFACTURING LIQUID EJECTING APPARATUS

CROSS-REFERENCE TO RELATED APPLICATIONS

This non-provisional application claims priority under 35 U.S.C. §119(a) on Patent Application No. 2009-058177 filed in Japan on Mar. 11, 2009, the entire contents of which are hereby incorporated by reference.

TECHNICAL FIELD

The present invention relates to a liquid ejecting apparatus such as an inkjet printer apparatus and a method for manufacturing the same, and more particularly, it relates to a wiring form for an actuator generating a liquid ejecting pressure and a drive circuit.

BACKGROUND

As an example of a liquid ejecting apparatus, an ink-jet type printer apparatus including a liquid ejecting head for ejecting a liquid (an ink) through a nozzle hole onto a recording target material has been known. The liquid ejecting head equipped in the printer apparatus includes a flow passage unit in which a plurality of channels each connecting a pressure chamber and a nozzle hole to each other are formed; and an actuator for applying an ejecting pressure to an ink contained in the pressure chamber. The liquid ejecting head distributes an ink supplied from a tank to a plurality of pressure chambers and applies a pulsed pressure to one or a plurality of pressure chambers out of all the pressure chambers. Thus, the liquid is ejected through a nozzle hole linked with each pressure chamber to which the pressure has been applied, so that the ejected liquid may be adhered onto a recording target material for forming an image thereon. At this point, an example of the actuator used for applying a pressure to an ink contained in a pressure chamber is a piezoelectric actuator, and a drive circuit is provided for driving the piezoelectric actuator.

For example, as described in Japanese Patent Application Laid-Open No. 2007-196404, the drive circuit is provided on a flexible board, a ground line and a high potential line corresponding to input lines to the drive circuit are formed on the flexible board, and a plurality of signal lines for inputting control signals for operating the drive circuit are also formed thereon. Such a flexible board is connected to the piezoelectric actuator, and the drive circuit and the piezoelectric actuator are connected to each other through a plurality of driving voltage lines through which voltages selectively output from the drive circuit are input to respective individual electrodes of the piezoelectric actuator. Furthermore, another ground line is formed on the flexible board in order to apply a ground voltage to a common electrode of the piezoelectric actuator.

In such a piezoelectric actuator, when an individual electrode is biased toward a high potential by a driving potential selectively output from the drive circuit, a predetermined electric field is generated between the common electrode biased toward a low potential through the ground line and the individual electrode. Due to the generated electric field, an active portion of a piezoelectric layer disposed between these electrodes is deformed, and hence, a pressure is applied to an ink contained in the pressure chamber so as to eject the ink from a nozzle hole.

It is noted that a larger number of lines are provided between a drive circuit and a piezoelectric actuator so as to reduce a line pitch in accordance with increase of channels, and hence, inexpensive general purpose products such as an FFC (Flexible Flat Cable) cannot be used as a flexible board connected to a piezoelectric actuator, and therefore, it is necessary to use a flexible board according to the specifications of a piezoelectric actuator. Moreover, a COF (Chip On Film) on which lines are formed as desired and a drive circuit is mounted may be used, and thus, a flexible board to be used tends to be expensive. Therefore, Japanese Patent Application Laid-Open No. 2007-196404 discloses a structure in which a flexible board is divided into two parts, that is, a COF on which a drive circuit is mounted and which is connected to a piezoelectric actuator and a general purpose FPC (Flexible Printed Circuit) extending from the COF toward a main body of a printer apparatus, and thus, an expensive COF is employed in a necessary region alone.

SUMMARY

In the manufacturing process for the piezoelectric actuator, polarization processing is performed in order to make an active portion of a piezoelectric layer function as a driver part for allowing an ink to be ejected. In the polarization processing, however, a voltage for the polarization processing is sometimes applied by utilizing the flexible board connected to the piezoelectric actuator. In such a case, since one of the ground lines is connected to the piezoelectric actuator and the other is connected to the drive circuit as described above, when the voltage for the polarization processing is applied, the voltage is applied through the drive circuit, and hence, the drive circuit may be damaged if the voltage is higher than a specified voltage value of the drive circuit. Therefore, it is convenient that these ground lines are independent of each other at the stage of polarizing the piezoelectric actuator. On the other hand, after polarizing the piezoelectric actuator, these ground lines are preferably short-circuited for reducing the electric resistance value of the ground lines. Therefore, Japanese Patent Application Laid-Open No. 2007-196404 discloses a structure in which the ground lines are short-circuited to each other after the polarization.

In order to short-circuit the ground lines, however, it is conventionally necessary to apply solder onto a proper portion (i.e., a solder point) or mount a circuit component manually so that the connection between the ground lines may be switched before and after the polarization processing. In addition, since such a manual operation should be performed after polarizing the piezoelectric actuator, the flexible board has been in a state where the piezoelectric actuator is connected thereto and the drive circuit is mounted thereon, which makes it difficult to improve the workability. Furthermore, the position for providing a solder point on the flexible board is restricted for securing the workability to be attained in such a state.

It is noted that the circumstances arise not only in the ink-jet type printer apparatus but also in general liquid ejecting apparatuses having a similar structure.

An object of the present invention is to provide a liquid ejecting apparatus in which a short-circuit may be caused between lines of the same potential formed on a flexible board without performing a particular operation after polarizing a piezoelectric actuator and a method for manufacturing the liquid ejecting apparatus.

A method for manufacturing a liquid ejecting apparatus according to a first aspect is a method for manufacturing a liquid ejecting apparatus, comprising: forming, on a flexible board, a first input line and a second input line for inputting a driving signal, for ejecting a liquid, respectively to a drive circuit and an actuator including a piezoelectric element operated by the drive circuit; mounting the drive circuit on the flexible board; providing a thermistor between the first input line and the second input line on the flexible board, the thermistor having a first resistance value with terminals provided therein being in an electrically disconnected state at a temperature not less than a predetermined temperature and having a second resistance value smaller than the first resistance value with the terminals being in an electrically connected state at a temperature lower than the predetermined temperature; connecting the flexible board to the actuator; polarizing the actuator by applying polarization heat not less than the predetermined temperature to the actuator for allowing the thermistor to have the first resistance value and inputting a polarization signal to the actuator through the first input line and the second input line; and making the actuator in a drivable state in accordance with input of the driving signal to the actuator through the first input line and the second input line with the thermistor allowed to have the second resistance value by removing the heat not less than the predetermined temperature.

Furthermore, a liquid ejecting apparatus according to a second aspect is a liquid ejecting apparatus, comprising: a drive circuit for driving an actuator including a piezoelectric element for ejecting a liquid; and a flexible board on which the drive circuit is mounted and which is connected to the actuator, wherein a first input line and a second input line for inputting a driving signal respectively to the drive circuit and the actuator when driving the actuator for ejecting a liquid are provided on the flexible board, and a thermistor is provided between the first input line and the second input line, the thermistor having a first resistance value with terminals provided therein being in an electrically disconnected state at a temperature not less than a predetermined temperature and having a second resistance value smaller than the first resistance value with the terminals being in an electrically connected state at a temperature lower than the predetermined temperature.

In the first and second aspects, the aforementioned structure, since the aforementioned thermistor is provided on the flexible board, a short-circuit may be caused between the first input line and the second input line without performing a particular operation after polarization processing for the piezoelectric actuator. Furthermore, since there is thus no need to perform an operation for causing a short-circuit after the polarization processing, the thermistor may be provided in a structurally appropriate position without restriction in workability to be attained after the polarization. It is noted that, for example, PolySwitch (registered trademark) may be employed as such a thermistor.

According to the first and second aspects, a liquid ejecting apparatus in which a short-circuit may be caused between lines of the same potential formed on a flexible board without performing a particular operation after polarizing a piezoelectric actuator, and a method for manufacturing the liquid ejecting apparatus are provided.

The above and further objects and features will more fully be apparent from the following detailed description with accompanying drawings.

DETAILED DESCRIPTION

Now, a liquid ejecting apparatus and a manufacturing method for the same according to an embodiment of the invention will be described by exemplifying application to an ink-jet printer apparatus (hereinafter referred to as the "printer apparatus"), that is, a kind of liquid ejecting apparatus, with reference to the accompanying drawings. The present invention is, however, not limited to the application to a printer apparatus but is applicable to a liquid ejecting apparatus that ejects a liquid other than an ink in general.

[Whole Structure of Printer Apparatus]

Figure 1:
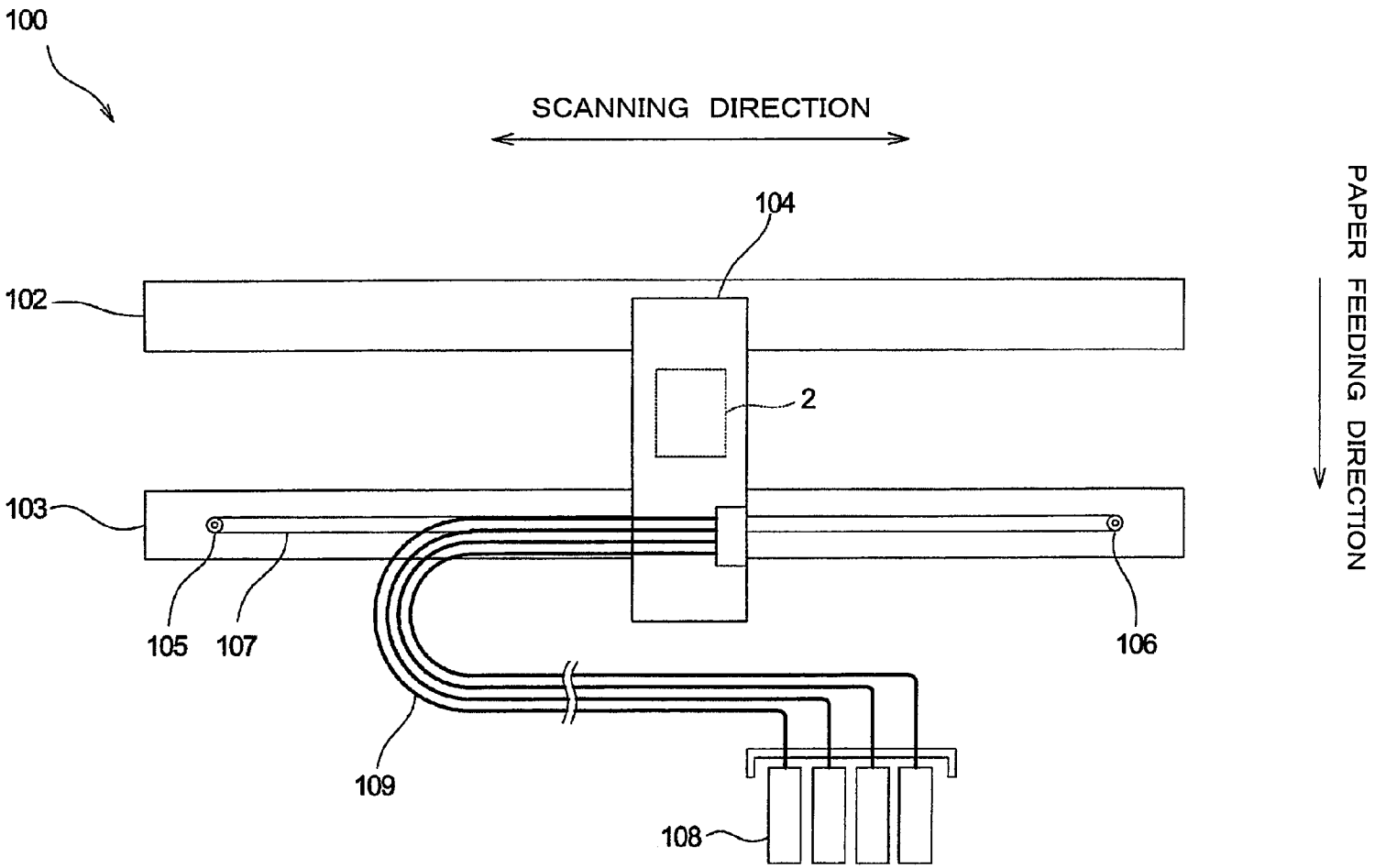
FIG. 1 is a schematic plan view illustrating a principal part of a printer apparatus corresponding to a liquid ejecting apparatus.

FIG. 1 is a schematic plan view illustrating a principal part of a printer apparatus 100 corresponding to a liquid ejecting apparatus. As illustrated in FIG. 1, the printer apparatus 100 includes a pair of guide rails 102 and 103 extending in a lateral direction in substantially parallel to each other, and a liquid supply unit 104 is supported by the guide rails 102 and 103 slidably in a scanning direction. A pair of pulleys 105 and 106 are provided in the vicinity of right and left end portions (in the scanning direction) of the guide rail 103, and the liquid supply unit 104 is connected to a timing belt 107 wound around the pulleys 105 and 106. One pulley 106 is provided with a motor (not shown) for forward/reverse rotative drive, and the timing belt 107 is capable of reciprocating in the leftward direction and the rightward direction through the forward/reverse rotative drive of the pulley 106, and in accordance with the reciprocation of the timing belt 107, the liquid supply unit 104 reciprocates in the lateral direction (i.e., the scanning direction) along the guide rails 102 and 103.

The printer apparatus 100 includes four ink cartridges 108 mounted removably through insertion for exchange. Four ink supply tubes 109 with flexibility for respectively supplying four color inks (of, for example, black, cyan, magenta and yellow) from these ink cartridges 108 are connected to the liquid supply unit 104. A liquid ejecting head 2 (see FIG. 2) is mounted on a lower portion of the liquid supply unit 104. The liquid ejecting head 2 ejects an ink (a liquid) onto a recording target material (such as a recording paper) fed below the liquid ejecting head 2 in a direction perpendicular to the scanning direction (i.e., a paper feeding direction), so as to form an image on the recording target material.

[Structure of Liquid Ejecting Head]

Figure 2:
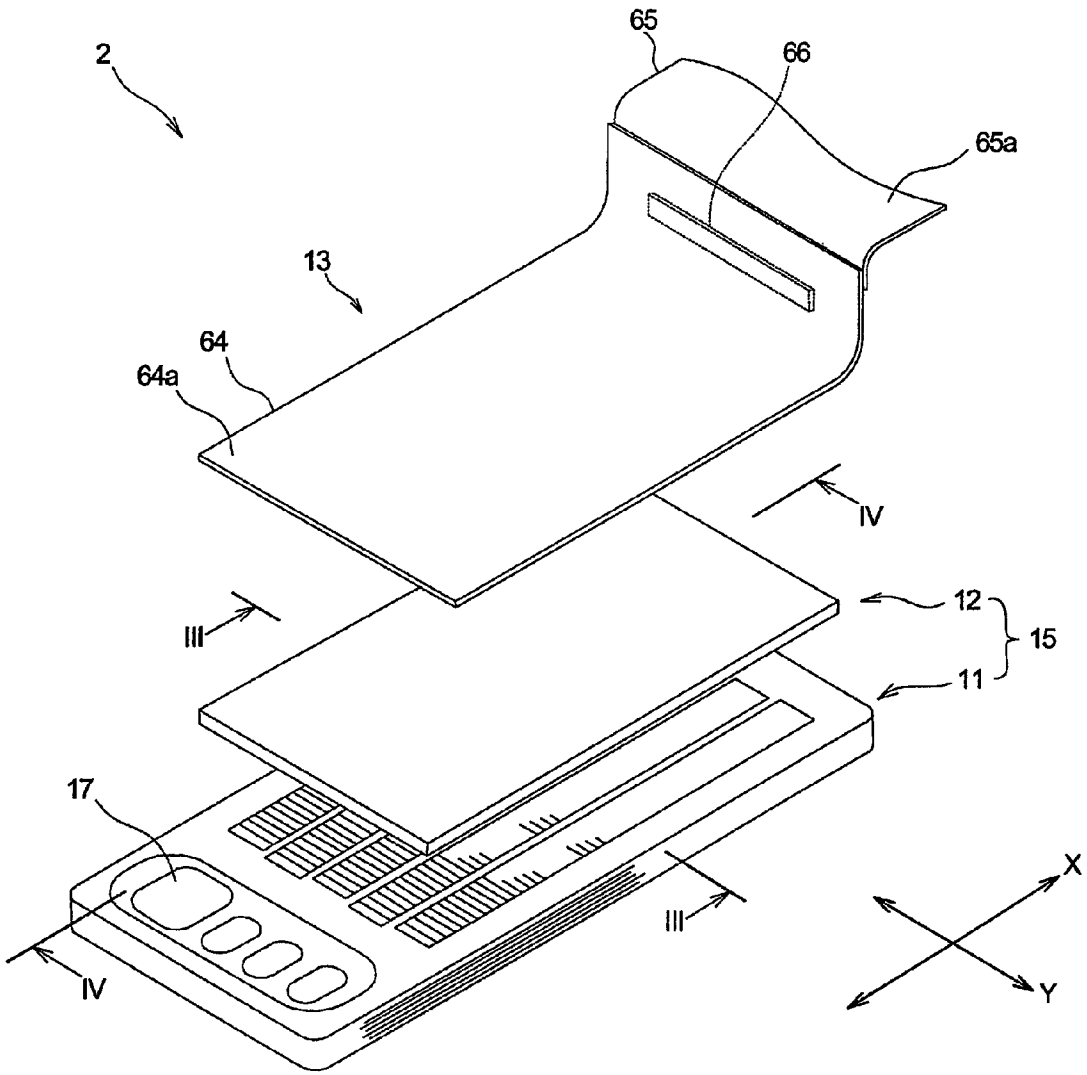
FIG. 2 is an exploded perspective view illustrating a structure of a liquid ejecting head included in the printer apparatus.

FIG. 2 is an exploded perspective view illustrating a structure of the liquid ejecting head 2 included in the printer apparatus 100. As illustrated in FIG. 2, the liquid ejecting head 2 includes a head main body 15 in which a piezoelectric actuator 12 is connected to a flow passage unit 11 from above; and a flexible board 13 connected to the piezoelectric actuator 12 to be disposed on the head main body 15. Furthermore, the flow passage unit 11 has a structure including a plurality of laminated plate members.

Figure 3:
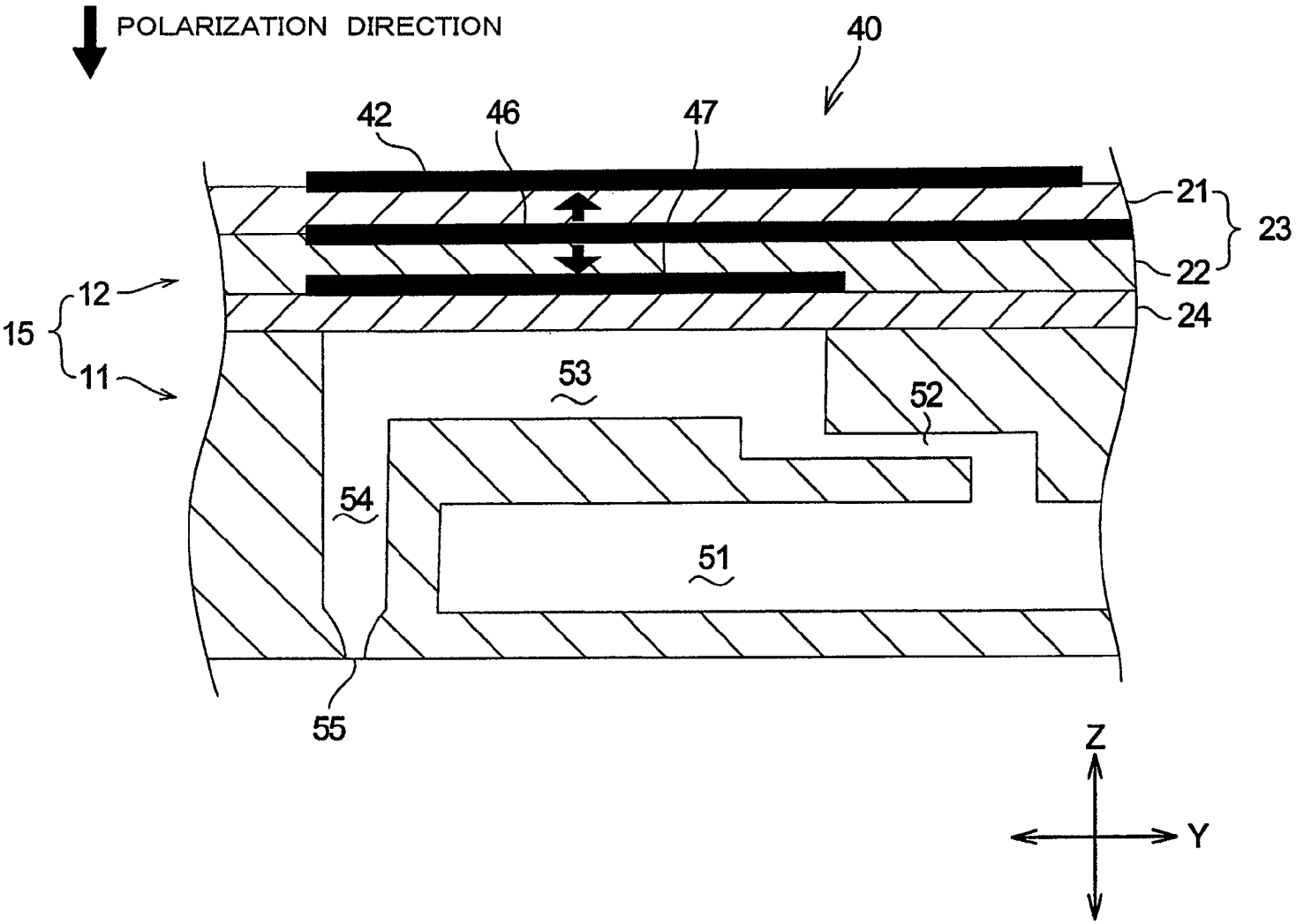
FIG. 3 is a cross-sectional view, taken on a line of FIG. 2 (i.e., a line along a nozzle row direction described later), illustrating a structure of a head main body in which a flow passage unit and a piezoelectric actuator are connected to each other.

FIG. 3 is a cross-sectional view illustrating a structure, taken on a line III-III of FIG. 2 (i.e., a line along a nozzle row direction described later), of the head main body 15 in which the flow passage unit 11 and the piezoelectric actuator 12 are connected to each other. As illustrated in FIG. 3, the flow passage unit 11 has a plurality of nozzle holes 55 opened on the lower face of the flow passage unit 11, and the plural nozzle holes 55 are arranged in one column or a plurality of columns extending in one direction. The nozzle holes 55 arranged in one nozzle column are spaced from one another by a predetermined distance and eject a liquid (an ink) of the same color. A plurality of such nozzle columns are arranged in a direction substantially perpendicular to the nozzle columns at appropriate intervals, and five columns are provided in this embodiment correspondingly to the number of colors of liquids to be ejected.

Hereinafter, a direction in which the nozzle column extends is designated as the "nozzle column direction X", which corresponds to the paper feeding direction, and a nozzle row direction against the nozzle column direction X is designated as the "nozzle row direction Y", which corresponds to the scanning direction. It is noted that the liquid ejecting head 2 is reciprocated in the nozzle row direction Y (i.e., the scanning direction).

Within the flow passage unit 11, manifolds 51 each corresponding to a common storage chamber for temporarily storing a liquid, and a plurality of channels respectively linking the manifolds 51 with the respective nozzle holes 55 are formed. Each channel includes various spaces such as a pressure chamber 53 provided correspondingly to each nozzle hole 55 for temporarily storing a liquid, a narrowing portion 52 for linking the manifold 51 with the pressure chamber 53 and a descender hole 54 for linking the nozzle hole 55 with the pressure chamber 53.

As illustrated in FIG. 2, a liquid supply port 17 connected to a liquid tank (not shown) is provided with respect to each color of the liquid on an upper face of the flow passage unit 11. A liquid supplied from the liquid tank to each liquid supply port 17 flows into the manifold 51 provided within the flow passage unit 11 and reaches the pressure chamber 53 through the narrowing portion 52. When an ejecting pressure is applied to the liquid contained in the pressure chamber 53 by driving the piezoelectric actuator 12, the thus obtained pressure wave is propagated also to a portion of the liquid disposed in the vicinity of the nozzle hole 55 through the descender hole 54, resulting in ejecting the liquid through the nozzle hole 55.

[Piezoelectric Actuator]

Figure 4:
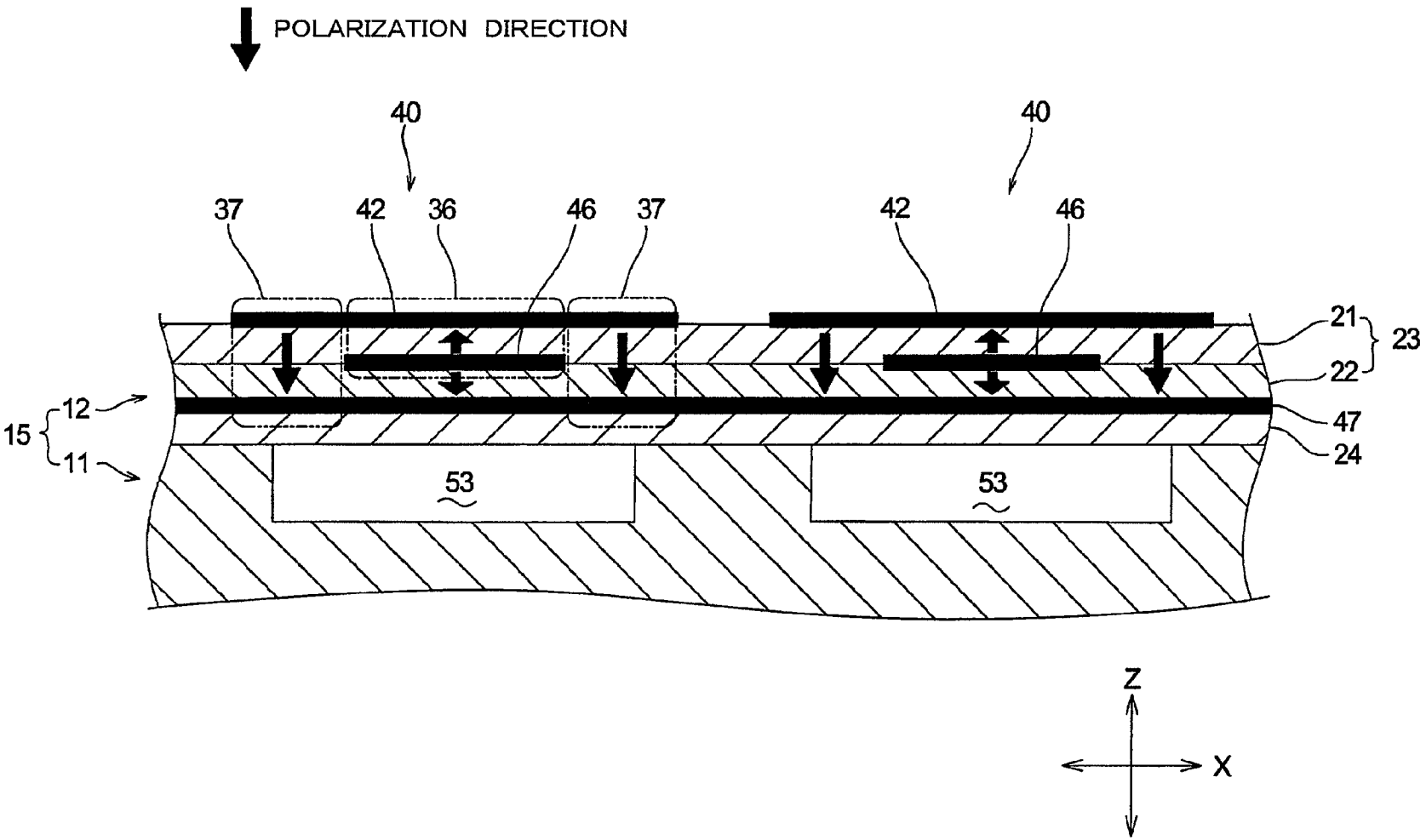
FIG. 4 is a cross-sectional view, taken on a line IV-IV of FIG. 2 (i.e., a line along a nozzle column direction describe later), illustrating the structure of the head main body in which the flow passage unit and the piezoelectric actuator are connected to each other.
Figure 5:
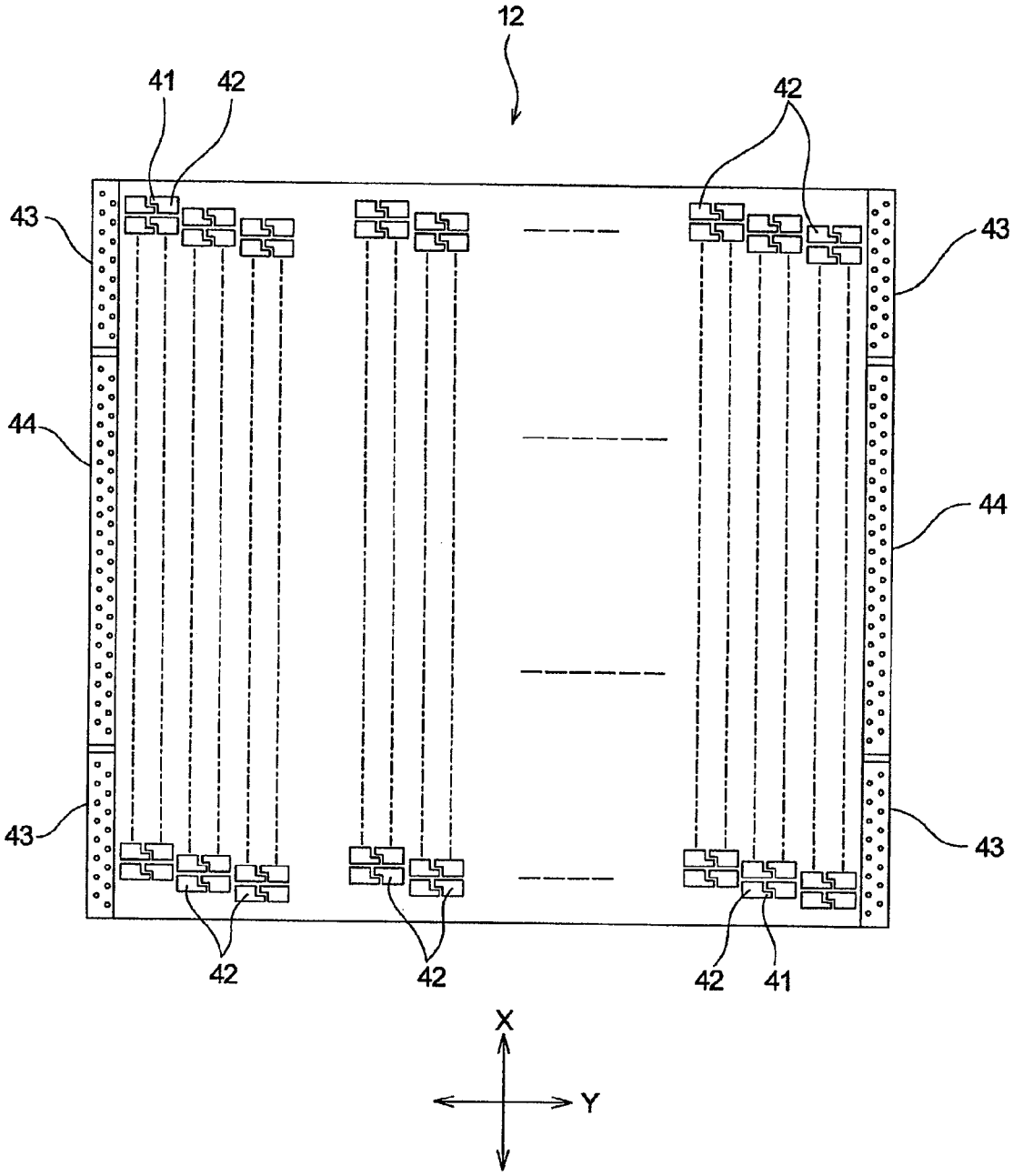
FIG. 5 is a plan view of the piezoelectric actuator.

FIG. 4 is a cross-sectional view illustrating a structure, taken on a line IV-IV of FIG. 2 (i.e., a line in the nozzle column direction), of the head main body 15 in which the flow passage unit 11 and the piezoelectric actuator 12 are connected to each other, and FIG. 5 is a plan view of the piezoelectric actuator 12.

As illustrated in FIGS. 3 and 4, the piezoelectric actuator 12 is connected to be stacked on the upper face of the flow passage unit 11, so as to cover the pressure chamber 53 opened on the upper face of the flow passage unit 11. The piezoelectric actuator 12 includes a piezoelectric layer 23 made of a piezoelectric material (such as PZT); and a base layer 24 (with a thickness of 20 μm) connected onto the upper face of the flow passage unit 11 and having an upper face on which the piezoelectric layer 23 is stacked, and the piezoelectric layer 23 includes two upper and lower layers, that is, an upper piezoelectric layer 21 and a lower piezoelectric layer 22. Furthermore, on the upper face of the upper piezoelectric layer 21, an individual electrode 42 is provided correspondingly to each pressure chamber 53, and an upper constant potential electrode 46 is provided between the upper piezoelectric layer 21 and the lower piezoelectric layer 22 correspondingly to each individual electrode 42 (namely, correspondingly to each pressure chamber 53). Furthermore, a lower constant potential electrode 47 is provided between the lower piezoelectric layer 22 and the base layer 24. It is noted that a direction for stacking the piezoelectric layer 23 included in the piezoelectric actuator 12 is hereinafter referred to as the "stacking direction Z". It is also noted that the material for the base layer is not limited to the piezoelectric material but may be thin stainless steel or the like.

Among the aforementioned electrodes, the individual electrodes 42 are arranged at substantially constant intervals in the nozzle column direction X on the upper face of the upper piezoelectric layer 21 so as to respectively oppose the pressure chambers 53, and are arranged to be shifted from one another in a zigzag manner in the nozzle row direction Y. A part of each individual electrode 42 is protruded in the nozzle row direction Y, and this protruded portion works as a connection terminal 41 to be connected to an individual electrode connection land 60 (see FIG. 6) of the flexible board 13. Furthermore, a potential on the individual electrode 42 may be switched between a high potential (of 28 V) and a low potential (of 0 V) by a driving pulse supplied from a drive circuit.

The upper constant potential electrodes 46 are arranged at substantially constant intervals in the nozzle column direction X on the upper face of the lower piezoelectric layer 22, and a plurality of columns of the upper constant potential electrodes 46 thus arranged are disposed side by side in the nozzle row direction Y. Therefore, the upper constant potential electrodes 46 and the individual electrodes 42 overlap each other in the stacking direction Z. Furthermore, all the upper constant potential electrodes 46 included in the piezoelectric actuator 12 are electrically connected to one another, so that a common potential (of, for example, 28 V) may be applied to all the upper constant potential electrodes 46.

The lower constant potential electrodes 47 are formed in the shape of a plurality of belts extending in the nozzle column direction X so as to work as a common electrode for the pressure chambers 53 arranged in the nozzle column direction X, and the lower constant potential electrodes 47, the upper constant potential electrodes 46 and the individual electrodes 42 overlap one another in the stacking direction Z. All the lower constant potential electrodes 47 included in the piezoelectric actuator 12 are electrically connected to one another, so that a common potential (of, for example, 0 V) may be applied to all the lower constant potential electrodes 47.

At this point, as illustrated in the cross-sectional view of FIG. 4, a dimension in the nozzle column direction X of each upper constant potential electrode 46 is smaller than a dimension in the nozzle column direction X of each individual electrode 42, and when seen in the stacking direction Z, the upper constant potential electrode 46 is disposed in substantially the center in the nozzle column direction X of the individual electrode 42. Accordingly, in substantially the center in the nozzle column direction X of the individual electrode 42, the individual electrode 42, the upper constant potential electrode 46 and the lower constant potential electrode 47 overlap one another in the stacking direction Z. A portion of the piezoelectric actuator 12 where the upper piezoelectric layer 21 is thus sandwiched between the individual electrode 42 and the upper constant potential electrode 46 is hereinafter referred to as a "first active portion 36". On the other hand, in end portions in the nozzle column direction X of the individual electrode 42, the individual electrode 42 and the lower constant potential electrode 47 overlap each other in the stacking direction Z without the upper constant potential electrode 46 sandwiched therebetween. Portions of the piezoelectric actuator 12 where the upper piezoelectric layer 21 and the lower piezoelectric layer 22 are sandwiched between the both end portions in the nozzle column direction X of the individual electrode 42 and the lower constant potential electrode 47 are hereinafter referred to as "second active portions 37".

As illustrated in FIG. 5, first surface common electrodes 44 and second surface common electrodes 43 are formed in both end portions in the nozzle row direction Y on the upper face of the piezoelectric actuator 12. Out of these electrodes, the first surface common electrodes 44 are electrically connected to the upper constant potential electrodes 46 through conductive materials filled in through holes penetrating the upper piezoelectric layer 21 in the stacking direction Z. Also, the second surface common electrodes 43 are electrically connected to the lower constant potential electrodes 47 through conductive materials filled in through holes penetrating the upper piezoelectric layer 21 and the lower piezoelectric layer 22 in the stacking direction Z.

As illustrated in FIGS. 3 and 4, in the piezoelectric actuator 12 having the aforementioned structure, the individual electrode 42, the upper constant potential electrode 46, the lower constant potential electrode 47 and a portion of the piezoelectric layer 23 sandwiched between the individual electrode 42 and the lower constant potential electrode 47 together form an energy generation portion 40 provided correspondingly to each pressure chamber 53 for applying a liquid ejecting pressure to the pressure chamber 53, and the two kinds of active portions 36 and 37 formed by the three kinds of electrodes 42, 46 and 47 may be operated with crosstalk suppressed. In order to input a driving signal (a driving voltage) to the energy generation portion 40, the aforementioned connection terminal 41 is provided correspondingly to each energy generation portion 40, and the connection terminals 41 are arranged on the upper face of the piezoelectric actuator 12 in one column or a plurality of columns extending in the nozzle column direction X.

[Flexible Board]

Next, the flexible board 13 will be described. As illustrated in FIG. 2, the flexible board 13 includes a COF (Chip On Film) 64 corresponding to a first flexible board on which a drive circuit 66 is mounted; and an FPC (Flexible Printed Circuit) 65 corresponding to a second flexible board. In the COF 64 and the FPC 65, a plurality of lines are formed on faces on one side of a first base sheet 64*a* and a second base sheet 65*a* which are made of a rectangular flexible sheet material with an electric insulating property such as polyimide, and the COF 64 and the FPC 65 are connected to each other and also connected to the piezoelectric actuator 12. The COF 64 and FPC 65 will now be described in detail.

Figure 6:
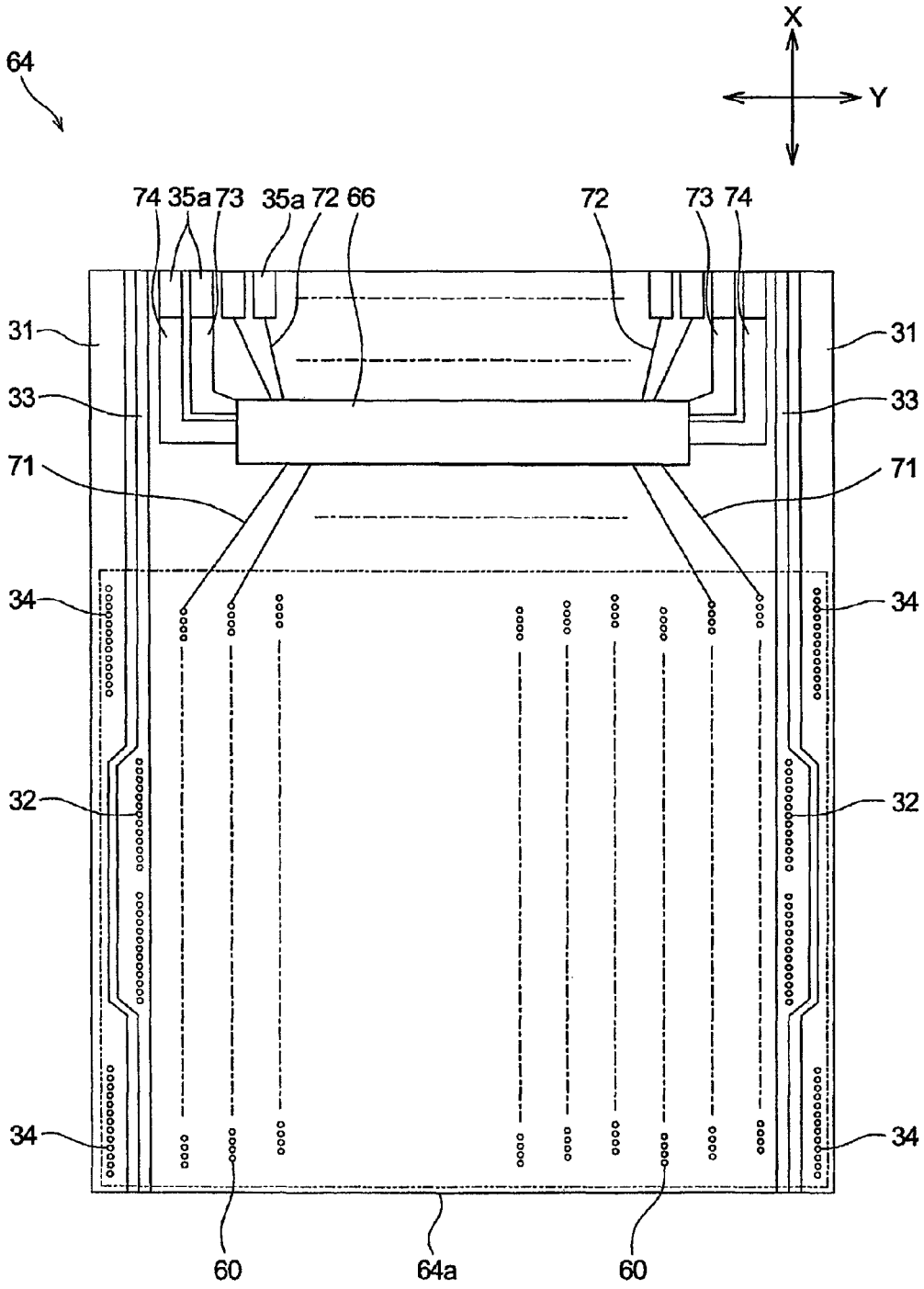
FIG. 6 is a bottom view illustrating a structure of a COF corresponding to a first flexible board.

FIG. 6 is a bottom view illustrating a structure of the COF 64 corresponding to the first flexible board. As illustrated in FIG. 6, in the COF 64, the drive circuit 66 is mounted on one face (a lower face) of the first base sheet 64*a* in the vicinity of one end thereof in the nozzle column direction X. Also, on the same face as the face on which the drive circuit 66 is mounted, COF-side low potential bias lines 31 (second low potential input lines: COM) are formed in end portions in the nozzle row direction Y, and COF-side high potential bias lines 33 (second high potential input lines: VCOM) are formed in parallel to and on the inner sides of the COF-side low potential bias lines 31. Furthermore, a plurality of individual electrode connection lands 60 are formed between the COF-side high potential bias lines 33 on the face on which the drive circuit 66 is mounted. Moreover, a plurality of common electrode connection lands 32 and 34 are formed respectively on the COF-side low potential bias lines 31 and the COF-side high potential bias lines 33.

The lower face of the first base sheet 64*a* is covered with a cover layer made of a flexible synthetic resin having an electrically insulating property (such as a resist), and holes are formed in portions of the cover layer overlapping the common electrode connection lands 32 and 34 and the individual electrode connection lands 60, so as to expose the common electrode connection lands 32 and 34 and the individual electrode connection lands 60 in the holes. The common electrode connection lands 32 and 34 and the individual electrode connection lands 60 of the COF 64 are connected to the first surface common electrodes 44, the second surface common electrodes 43 and the connection terminals 41 of the individual electrodes 42 (see FIG. 5) of the piezoelectric actuator 12 through bumps or conductive adhesives not shown.

On the other hand, output-side lines 71, in the same number as the number of the individual electrode connection lands 60, for applying a driving potential to the individual electrodes 42 of the piezoelectric actuator 12 are provided so as to extend side by side on the lower face of the first base sheet 64*a* from the drive circuit 66, and the output-side lines 71 are respectively connected to the individual electrode connection lands 60 independently of one another. Furthermore, a variety of input-side lines 72, such as a waveform signal line for specifying a driving mode of the piezoelectric actuator 12, a print data line for indicating a driving signal of each channel output from the drive circuit 66 to each individual electrode 42, a plurality of control signal lines for transferring a clock signal and the like, and a power voltage line and a ground voltage line for the drive circuit 66 itself, are provided to extend side by side from the drive circuit 66. The input-side lines 72 are connected to a plurality of first connection electrodes 35*a* provided in end portions in the nozzle column direction X of the first base sheet 64*a* in a one-to-one correspondence.

Furthermore, COF-side low potential driving lines 73 (first low potential input lines: VSS) for selectively applying a ground potential to the individual electrodes 42 of the piezoelectric actuator 12 from the drive circuit 66 are provided on the outer side in the nozzle row direction Y of the group of a plurality of input-side lines 72, and the ends of the COF-side low potential driving lines 73 are respectively connected to the first connection electrodes 35*a*. Also, COF-side high potential driving lines 74 (first high potential input lines: VDD) for selectively applying a high potential to the individual electrodes 42 of the piezoelectric actuator 12 from the drive circuit 66 are provided on the outer side of the COF-side low potential driving lines 73, and the ends of the COF-side high potential driving lines 74 are also respectively connected to the first connection electrodes 35*a*. Moreover, the output-side lines 71, the input-side lines 72, the COF-side low potential driving lines 73 and the COF-side high potential driving lines 74 are also covered with the cover layer.

The two groups each of four lines, that is, the COF-side low potential bias line 31, the COF-side high potential bias line 33, the COF-side low potential driving line 73 and the COF-side high potential driving line 74, are provided respectively in both end portions in the width direction of the COF for the following reason: If these groups of lines are provided in merely one of the end portions, voltages are supplied from merely one side along the lengthwise direction of the drive circuit 66 and the piezoelectric actuator 12 to which these lines 31 and 33 and lines 73 and 74 are respectively connected, and hence, voltage drop is caused on the other side in the lengthwise direction of the drive circuit 66 and the piezoelectric actuator 12, which may cause variation in ejecting characteristics. Therefore, the groups of the lines are provided so as to supply voltages from the both sides in the lengthwise direction of the drive circuit 66 and the piezoelectric actuator 12 for preventing the voltage drop.

Figure 7:
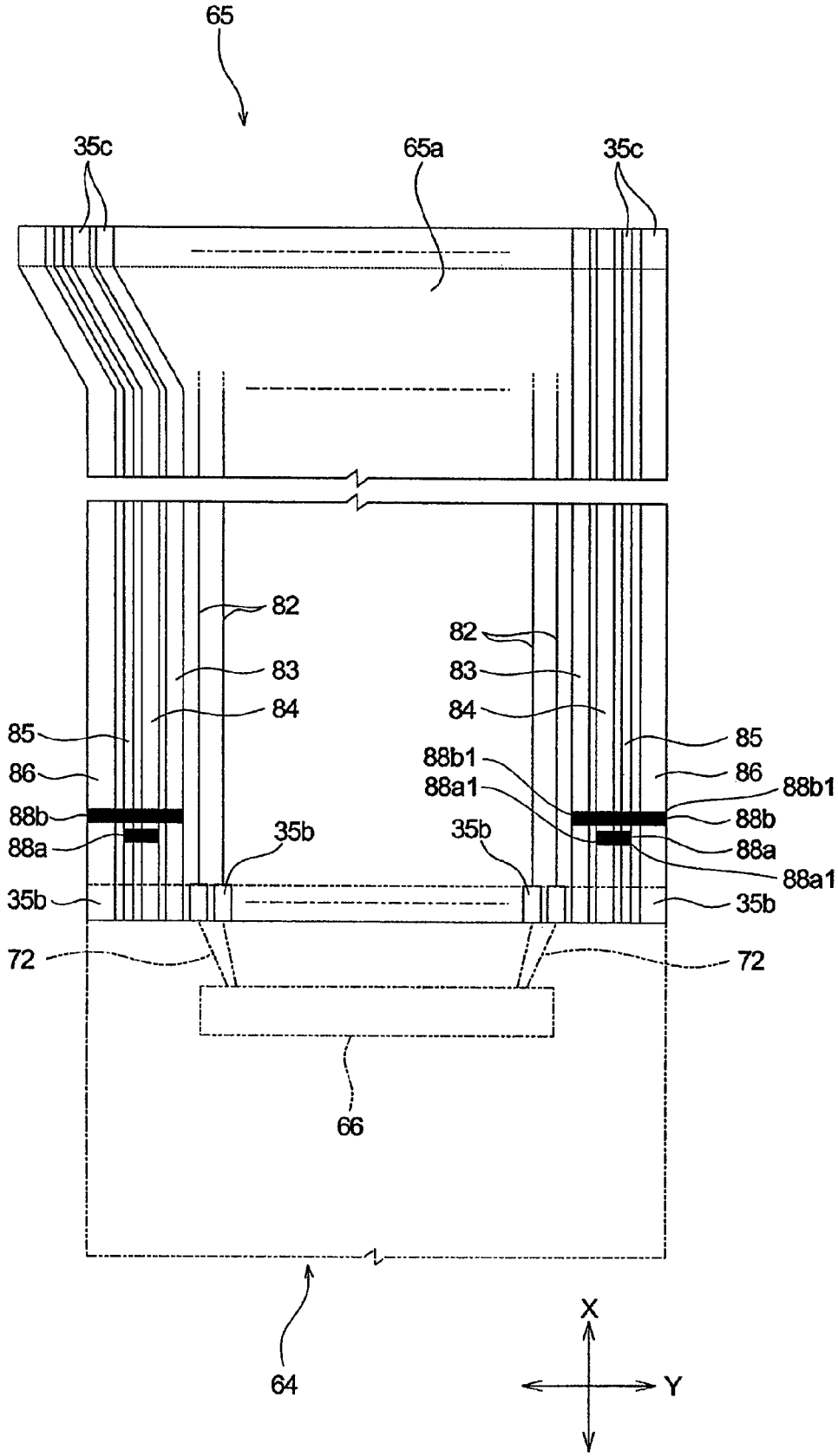
FIG. 7 is a plan view illustrating a structure of an FPC corresponding to a second flexible board in which a part of the COF connected to the FPC is illustrated with alternate long and two short dashes lines.

FIG. 7 is a plan view illustrating a structure of the FPC 65 corresponding to the second flexible board, in which a part of the COF 64 connected to the FPC 65 is illustrated with alternate long and two short dashed lines. As illustrated in FIG. 7, the FPC 65 is a general purpose cable having input-side lines 82, in the same number as the number of the input-side lines 72 of the COF 64, formed to extend side by side on one face (an upper face) of the second base sheet 65*a*. In one end portion of the FPC 65, second connection electrodes 35*b* connected to ends on one side of the input-side lines 82 and connected to the first connection electrodes 35*a* of the COF 64 are provided, and in the other end portion, third connection electrodes 35*c* connected to ends on the other side of the input-side lines 82 and connected to an interconnecting board (not shown) are provided.

On the both outer sides of the input-side lines 82, FPC-side low potential driving lines 83 (first low potential input lines: VSS), FPC-side high potential driving lines 84 (first high potential input lines: VDD), FPC-side high potential bias lines 85 (second high potential input lines: VCOM) and FPC-side low potential bias lines 86 (second low potential input lines: COM) are provided so as to be arranged in this order from the inside to the outside. Out of these lines, the FPC-side low potential driving lines 83 are connected to the COF-side low potential driving lines 73 of the COF 64 through the first and second connection electrodes 35*a* and 35*b* for inputting a low potential signal (a second potential signal) to the drive circuit 66, and the FPC-side high potential driving lines 84 are connected to the COF-side high potential driving lines 74 of the COF 64 through the first and second connection electrodes 35*a* and 35*b* for inputting a high potential signal (a first potential signal) to the drive circuit 66. Furthermore, the FPC-side high potential bias lines 85 are connected to the COF-side high potential bias lines 33 of the COF 64 through the first and second connection electrodes 35*a* and 35*b* for inputting a high potential signal (a third potential signal) to the piezoelectric actuator 12, and the FPC-side low potential bias lines 86 are connected to the COF-side low potential bias lines 31 of the COF 64 through the first and second connection electrodes 35*a* and 35*b* for inputting a low potential signal (a fourth potential signal) to the piezoelectric actuator 12.

Incidentally, the FPC 65 is provided with two thermistors 88*a* and 88*b* as illustrated in FIG. 7. One thermistor 88*a* is provided between the FPC-side high potential driving line 84 and the FPC-side high potential bias line 85 formed adjacent to each other, the other thermistor 88*b* is provided between the FPC-side low potential driving line 83 and the FPC-side low potential bias line 86 formed with the lines 84 and 85 sandwiched therebetween, and both the thermistors 88*a* and 88*b* are provided in the vicinity of a connecting portion to the COF 64 so as to be disposed in the vicinity of the drive circuit 66. This is for reducing voltage drop in a voltage input to the drive circuit 66 by suppressing the voltage to be smaller than a maximum rated voltage of the drive circuit 66 (that is, a sum of a power voltage of the drive circuit 66 itself and a power voltage VDD for driving it).

The thermistors 88*a* and 88*b* have two terminals 88*a*1, 88*a*1, and 88*b*1, 88*b*1, respectively, and have high resistance with the terminals being in a substantially electrically disconnected state (an insulating state) at a temperature not less than a predetermined temperature and have low resistance with the terminals being in a substantially electrically connected state (a conducting state) at a temperature lower than the predetermined temperature. In this embodiment, the "predetermined temperature" is set to a temperature attained by the thermistors 88*a* and 88*b* through heat (of approximately 80 through 130° C.) externally applied for activating a polarization state when polarizing the upper piezoelectric layer 21 and the lower piezoelectric layer 22 of the piezoelectric actuator 12. Furthermore, as the thermistors 88*a* and 88*b*, PolySwitch (registered trademark) is employed in this embodiment.

Figure 8:
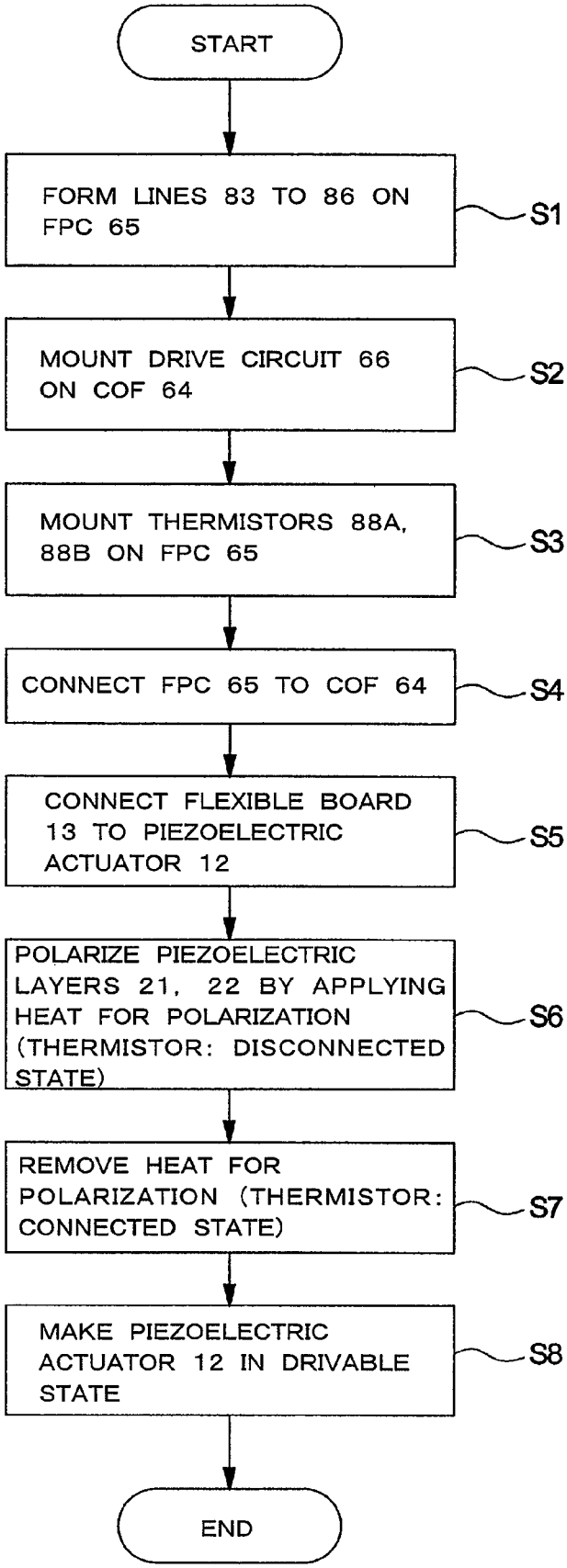
FIG. 8 is a flowchart explaining a part of a manufacturing method for a liquid ejecting head including an FPC.

FIG. 8 is a flowchart explaining a part of a manufacturing method for the liquid ejecting head 2 including the aforementioned FPC 65. As illustrated in FIG. 8, in the manufacturing method, the FPC-side low potential driving lines 83, the FPC-side high potential driving lines 84, the FPC-side high potential bias lines 85 and the FPC-side low potential bias lines 86 are first formed on the FPC 65 (S1). Thereafter, the drive circuit 66 is mounted on the COF 64 (S2), and the thermistors 88*a* and 88*b* are also mounted on the FPC 65 before or after step S2 (S3). Then, the FPC 65 is connected to the COF 64 separately manufactured (S4), and the thus obtained flexible board 13 is connected to the piezoelectric actuator 12 that has been connected to the flow passage unit 11 and has not been polarized yet (S5). At this point, the terminals 88*a*1, 88*a*1 and 88*b*1, 88*b*1 of the thermistors 88*a* and 88*b* are in a connected state, respectively. It is noted that the flexible board 13 may include a COF alone although it has the structure in this embodiment including the FPC 65 and the COF 64 connected to each other for reducing the cost.

Next, while predetermined heat for polarization (of approximately 80 through 130° C.) is applied to the piezoelectric actuator 12 not polarized yet by, for example, bringing a heater close to it or placing it in a furnace, the flexible board 13 is connected to polarization equipment (not shown). Then, the upper piezoelectric layer 21 and the lower piezoelectric layer 22 are polarized by causing a high potential difference by applying predetermined potentials (signals) for polarization to the individual electrode 42, the upper constant potential electrode 46 and the lower constant potential electrode 47 through the lines 83 through 86 (S6). For example, when a potential of 36 V and a potential of 0 V are applied respectively to the upper constant potential electrode 46 and the individual electrode 42, a high voltage is applied to the first active portion 36 and hence the first active portion 36 is polarized in an upward direction (see FIG. 4). When, for example, a potential of 28 V, a potential of −60 V and a potential of 28 V are applied respectively to the upper constant potential electrode 46, the lower constant potential electrode 47 and the individual electrode 42, the second active portion 37, and a portion sandwiched between the upper constant potential electrode 46 and the lower constant potential electrode 47 in the lower piezoelectric layer 22 are polarized in the downward direction (see FIG. 4). In the polarization processing, the terminals 88*a*1, 88*a*1 and 88*b*1, 88*b*1 of the thermistors 88*a* and 88*b* are respectively in a disconnected state because of the heat for polarization, and hence, different potentials (signals) in accordance with necessity may be applied to the lines 83 through 86 as exemplified above.

The polarization is performed with the terminals 88*a*1, 88*a*1 and 88*b*1, 88*b*1 of the thermistors 88*a* and 88*b* being in a disconnected state for the following reason: If the polarization processing is performed with the terminals being in a connected state, the COF-side high potential driving line 74 (the first high potential input line: VDD) and the COF-side high potential bias line 33 (the second high potential input line: VCOM) attain the same potential, and a high potential is applied to the drive circuit 66 through the COF-side high potential driving line 74, and hence, a voltage exceeding the maximum rated voltage specified for the drive circuit 66 may be applied so as to damage the drive circuit 66.

Subsequently, after the polarization processing performed in step S6, the piezoelectric actuator 12 is taken away from the heater or out of the furnace for removing the heat for polarization, and the flexible board 13 is disconnected from the polarization equipment (S7). Therefore, the temperature of the thermistors 88*a* and 88*b* is lowered, and the terminals thereof are in a connected state again, and therefore, the FPC-side high potential driving line 84 and the FPC-side high potential bias line 85 are short-circuited through the thermistor 88*a*, and the FPC-side low potential driving line 83 and the FPC-side low potential bias line 86 are short-circuited through the thermistor 88*b*. As a result, the piezoelectric actuator 12 is in a drivable state in accordance with input of signals to the lines 83 through 86 (S8).

It is noted that the removal of the heat applied in the polarization processing may be controlled in accordance with a measured current value because it may be determined whether the terminals 88*a*1, 88*b*1 are in a connected state or in a disconnected state as a result of the thermistors 88*a* and 88*b* attaining the predetermined temperature, based on a conducting state corresponding to whether or not a current passes between the terminals.

In such a printer apparatus 100, short-circuits may be respectively caused between the FPC-side high potential driving line 84 and the FPC-side high potential bias line 85 and between the FPC-side low potential driving line 83 and the FPC-side low potential bias line 86 after the polarization processing (S6) of the piezoelectric actuator 12 without performing a particular operation. Furthermore, since there is thus no need to perform an operation for causing short-circuits after the polarization processing, the thermistors 88*a* and 88*b* may be provided in structurally appropriate positions without restriction in the workability to be attained after the polarization.

Although the thermistors 88*a* and 88*b* are respectively provided between the FPC-side high potential driving line 84 and the FPC-side high potential bias line 85 and between the FPC-side low potential driving line 83 and the FPC-side low potential bias line 86 in the structure described herein, the thermistor 88*a* or 88*b* may be provided between one of these pairs of lines. Alternatively, the thermistors 88*a* and 88*b* may be provided on the COF 64 instead of the FPC 65. In this case, the thermistors 88*a* and 88*b* may be provided respectively between the COF-side high potential driving line 74 and the COF-side high potential bias line 33 and between the COF-side low potential driving line 73 and the COF-side low potential bias line 31, or the thermistor 88*a* or 88*b* may be provided between one of these pairs of lines.

Furthermore, although the polarization processing (S6) in which the thermistors 88*a* and 88*b* are in a disconnected state by the externally applied heat for polarization is exemplarily described in the aforementioned manufacturing method, this embodiment is not limited to this. For example, when performing the polarization, Joule heat is generated in the piezoelectric actuator 12 by currents of electric signals input to the lines 83 through 86, and hence, this heat may be used for making the thermistors 88*a* and 88*b* in a disconnected state. In this case, the thermistors 88*a* and 88*b* are selected so that they may not be in a disconnected state (namely, may be in a connected state) by Joule heat generated by signals input to the piezoelectric actuator 12 and the drive circuit 66 for the purpose of ejecting an ink after the polarization processing.

[Alternative Structure of Liquid Supply Unit]

Figure 9:
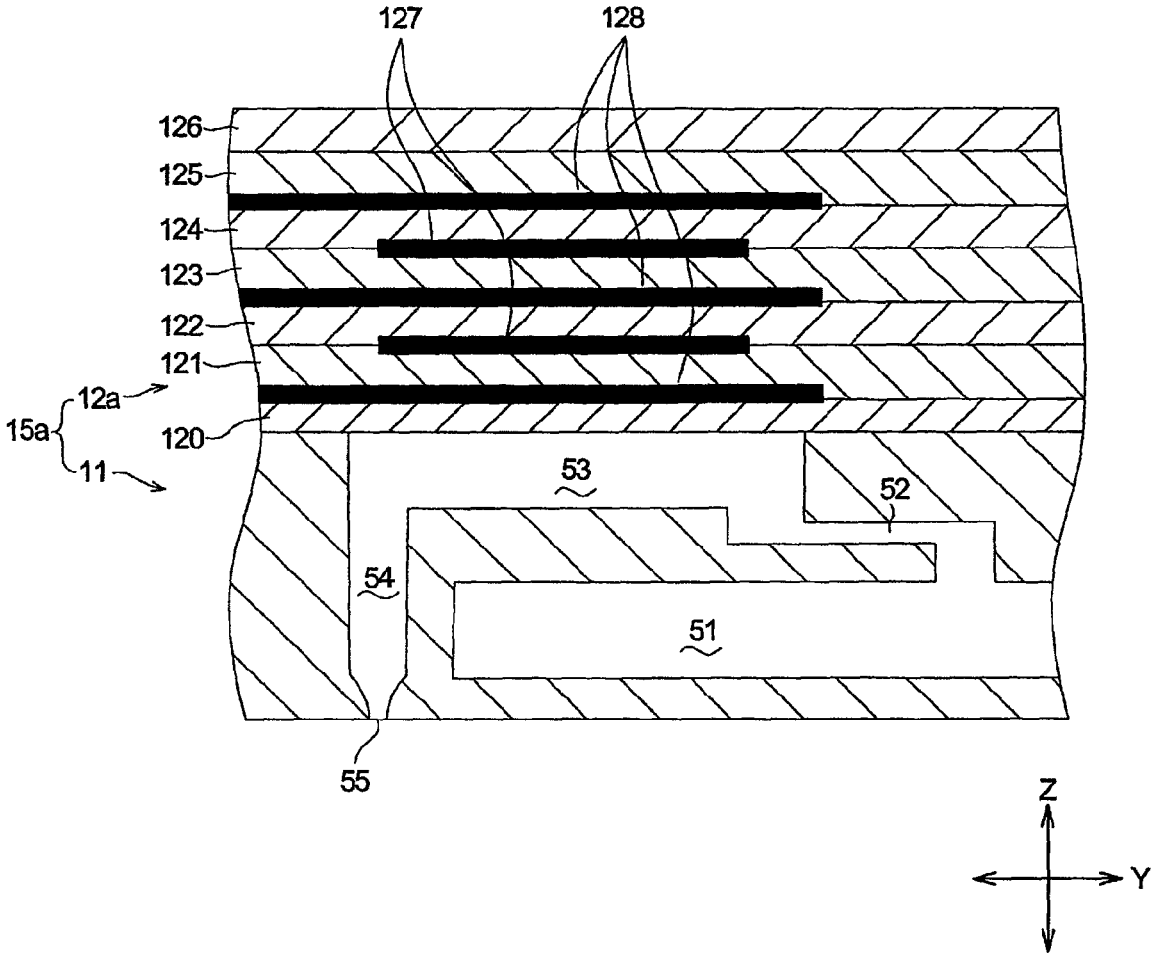
FIG. 9 is a cross-sectional view, taken on a line along the nozzle column direction, illustrating another structure of the head main body.

FIG. 9 is a cross-sectional view illustrating another structure of a head main body 15*a* taken on a line in the nozzle column direction X. It is noted that a flow passage unit 11 included in this head main body 15*a* has the same structure as that already described, and hence, like reference numerals are used to refer to like or corresponding elements so as to omit the description. Furthermore, also in structures described or illustrated below, like reference numerals are used to refer to like or corresponding elements already described or illustrated, so as to omit the description.

As illustrated in FIG. 9, a piezoelectric actuator 12*a* included in the head main body 15*a* has a laminated structure of a plurality of rectangular piezoelectric layers 120 through 125 and a top sheet 126 having an insulating property, and each of the piezoelectric layers 120 through 125 is made of a ceramic material such as lead zirconate titanate (PZT).

On the upper faces of the piezoelectric layers 121 and 123, that is, the second and fourth layers upward from the lowermost piezoelectric layer 120 out of the piezoelectric layer 120 through 125, a plurality of individual electrodes 127 arranged respectively correspondingly to the positions of the pressure chambers 53 are formed by printing correspondingly to the respective columns of the pressure chambers 53. Furthermore, on the upper faces of the piezoelectric layers 120, 122 and 124, that is, the first, third and fifth layers upward from the lowermost piezoelectric layer 120, common electrodes 128 are formed by printing so as to cover all the individual electrodes 127 of each column in a plan view. The individual electrodes 127 and the common electrodes 128 are electrically connected to a plurality of driving electrodes (not shown) provided on the upper face of the top sheet 126 through interconnecting lines not shown provided on side end faces of the piezoelectric layers 120 through 125 and the top sheet 126 or provided in through holes not shown. The piezoelectric actuator 12*a* has a structure, in a plan view, obtained substantially by excluding the first surface common electrodes 44 from the piezoelectric actuator 12 illustrated in FIG. 5.

Figure 10A:
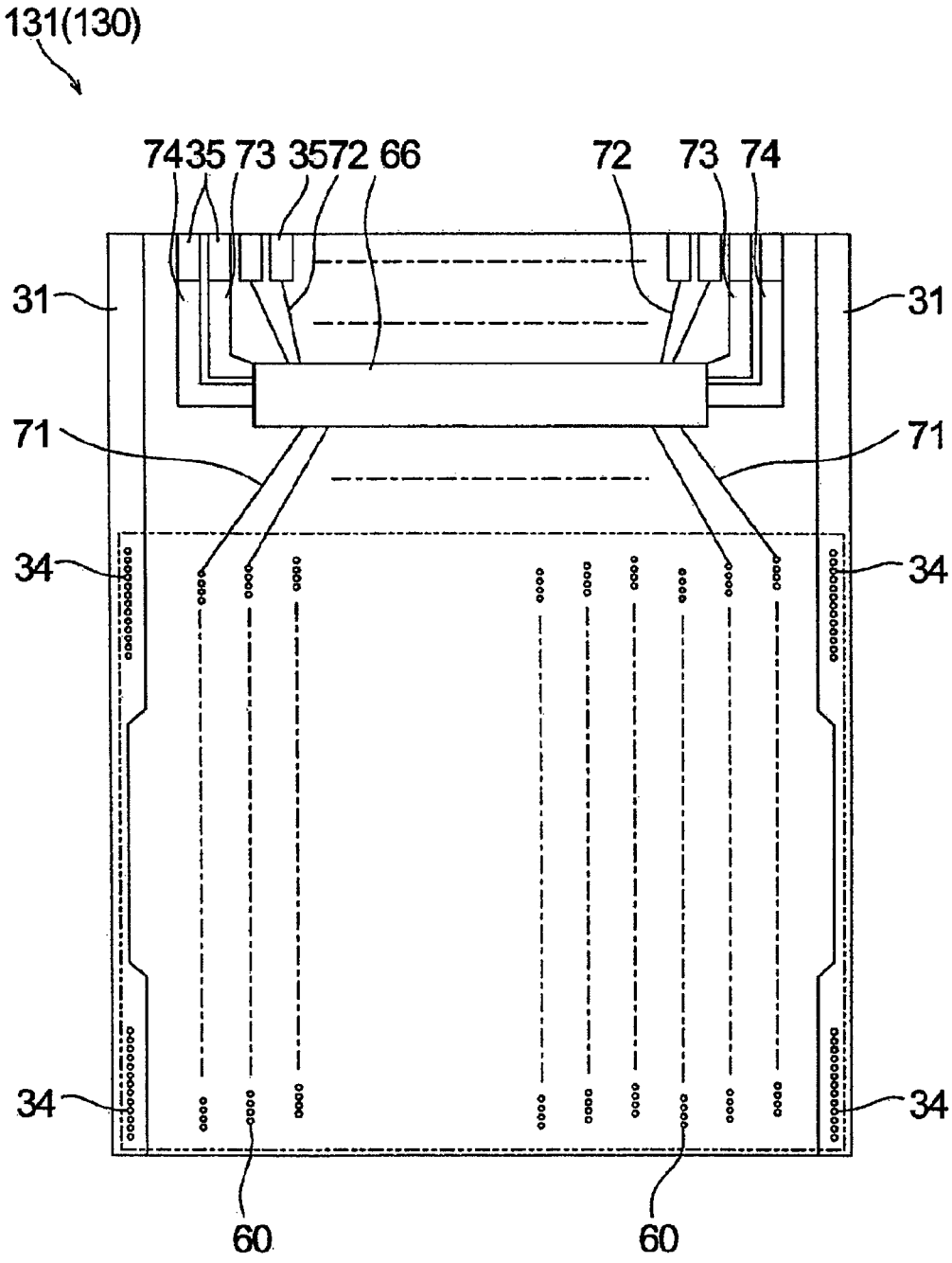
FIG. 10A is a bottom view of a COF, that is, a flexible board connected to a piezoelectric actuator.
Figure 10B:
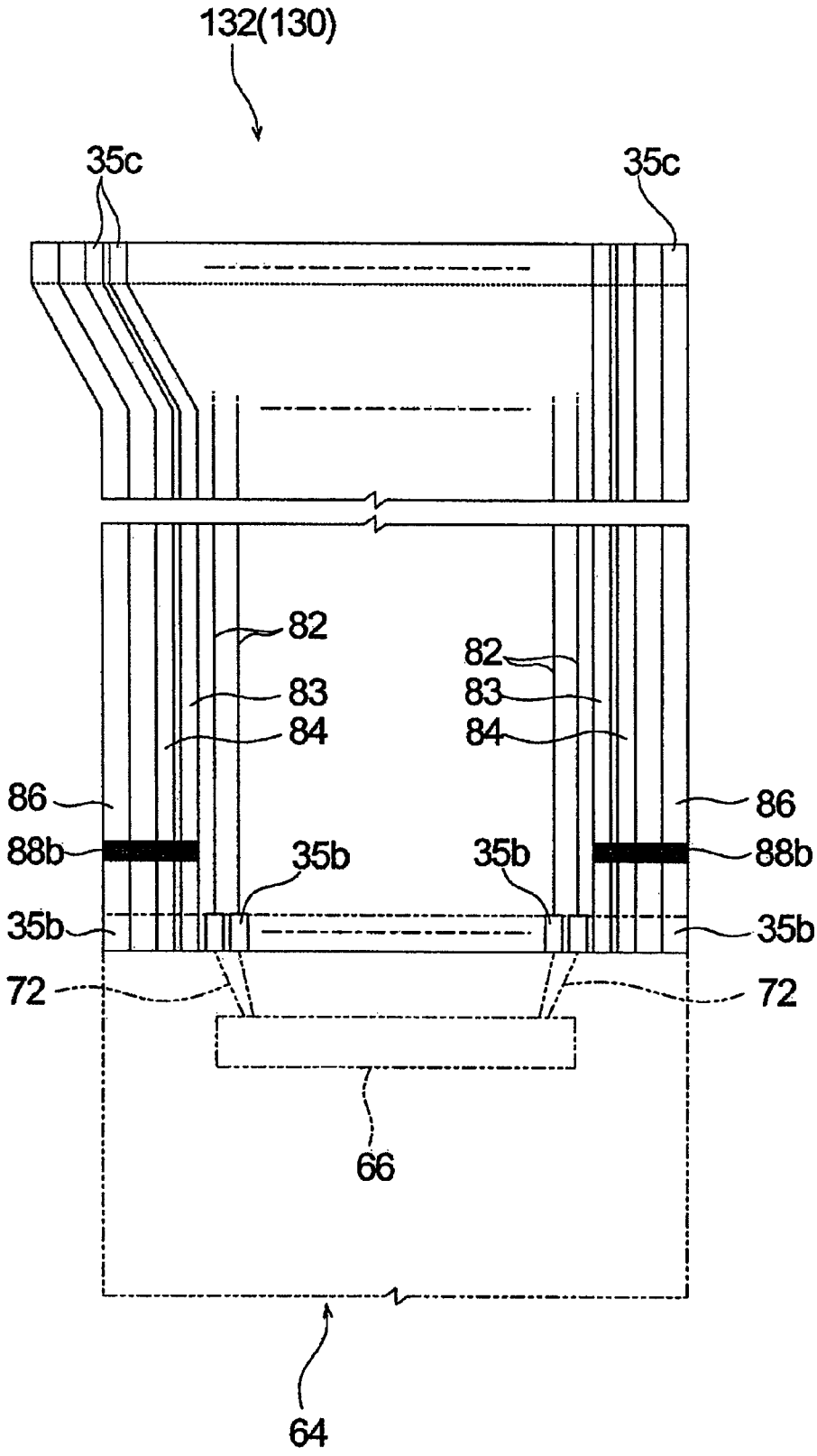
FIG. 10B is a plan view of an FPC, that is, a flexible board connected to a piezoelectric actuator.

FIGS. 10A and 10B illustrate a flexible board 130 to be connected to the piezoelectric actuator 12*a*, and specifically, FIG. 10A is a bottom view of a COF 131 and FIG. 10B is a plan view of an FPC 132. As illustrated in FIG. 10A, the COF 131 to be connected to the piezoelectric actuator 12*a* has a structure obtained by substantially excluding the COF-side high potential bias lines 33 (the second high potential input lines: VCOM) from the COF 64 illustrated in FIG. 6 correspondingly to the first surface common electrodes 44 being excluded from the piezoelectric actuator 12*a*, and the rest is the same as the structure of the COF 64. Accordingly, COF-side low potential driving lines 73 (first low potential input lines: VSS), COF-side high potential driving lines 74 (first high potential input lines: VDD), and COF-side low potential bias lines 31 (second low potential input lines: COM) are provided in both end portions in the nozzle row direction Y of the COF 131 so as to be arranged in this order from the inside to the outside.

On the other hand, as illustrated in FIG. 10B, the FPC 132 has a structure obtained by substantially excluding the FPC-side high potential bias lines 85 (VCOM) from the FPC 65 illustrated in FIG. 7 correspondingly to the COF-side high potential bias lines 33 being excluded in the COF 131, and the rest is the same as the structure of the FPC 65. Accordingly, FPC-side low potential driving lines 83 (first low potential input lines: VSS), FPC-side high potential driving lines 84 (first high potential input lines: VDD) and FPC-side low potential bias lines 86 (second low potential input lines: COM) are provided in both end portions in the nozzle row direction Y of the FPC 132 so as to be arranged in this order from the inside to the outside.

The COF 131 and the FPC 132 having the aforementioned structures are connected to each other. As a result, the COF-side low potential driving lines 73, the COF-side high potential driving lines 74 and the COF-side low potential bias lines 31 are respectively connected to the FPC-side low potential driving lines 83, the FPC-side high potential driving lines 84 and the FPC-side low potential bias lines 86 through first and second connection electrodes 35*a* and 35*b*.

In the FPC 132 of this embodiment, thermistors 88*b* similar to the aforementioned thermistors are provided between the FPC-side low potential driving lines 83 and the FPC-side low potential bias lines 86. Furthermore, the head main body 15*a* including the FPC 132 may be manufactured through procedures similar to those described with reference to FIG. 8.

Accordingly, also in a printer apparatus 100 including the head main body 15*a*, the FPC-side low potential driving line 83 and the FPC-side low potential bias line 86 may be short-circuited after the polarization processing for the piezoelectric actuator 12*a* (S6 of FIG. 8) without performing a particular operation. Furthermore, since there is thus no need to perform an operation for causing a short-circuit after the polarization processing, the thermistors 88*b* may be provided in structurally appropriate positions without restriction in the workability to be attained after the polarization.

Although the FPC-side low potential driving line 83 and the FPC-side low potential bias line 86 are formed with the FPC-side high potential driving line 84 sandwiched therebetween in the structure described above, the FPC-side low potential driving line 83 and the FPC-side low potential bias line 86 may be disposed adjacent to each other with the FPC-side high potential driving line 84 disposed on the outer side of them. Furthermore, the thermistors 88*b* may be provided on the COF 131 instead of the FPC 132. In this case, the thermistors 88*b* may be provided between the COF-side low potential driving lines 73 and the COF-side low potential bias lines 31.

The present invention is applicable to a liquid ejecting apparatus in which a short-circuit may be caused between lines of the same potential formed on a flexible board without performing a particular operation after polarization of a piezoelectric actuator, and a method for manufacturing the liquid ejecting apparatus.

As this description may be embodied in several forms without departing from the spirit of essential characteristics thereof, the present embodiment is therefore illustrative and nor restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A method for manufacturing a liquid ejecting apparatus, comprising:

forming, on a flexible board, a first input line and a second input line for inputting a driving signal, for ejecting a liquid, respectively to a drive circuit and an actuator including a piezoelectric element operated by the drive circuit;

mounting the drive circuit on the flexible board;

providing a thermistor between the first input line and the second input line on the flexible board, the thermistor having a first resistance value with terminals provided therein being in an electrically disconnected state at a temperature greater than or equal to a predetermined temperature, and having a second resistance value less than the first resistance value with the terminals being in an electrically connected state at a temperature less than the predetermined temperature;

connecting the flexible board to the actuator;

applying polarization heat greater than or equal to the predetermined temperature to the actuator while the thermistor has the first resistance value and the first input line and the second input line are in an electrically disconnected state from each other, and then applying different potentials to the first input line and the second input line so as to input a polarization signal to the actuator through the first input line and the second input line, respectively, thereby polarizing the actuator; and removing the polarization heat that is greater than or equal to the predetermined temperature from the actuator while the thermistor has the second resistance value and the first input line and the second input line are in an electrically connected state with each other via the thermistor, and then placing the actuator in a drivable state in accordance with input of the driving signal to the actuator through the first input line and the second input line.

2. A liquid ejecting apparatus, comprising:

a drive circuit for driving an actuator including a piezoelectric element for ejecting a liquid;

a flexible board on which the drive circuit is mounted and which is connected to the actuator;

a first input line and a second input line provided on the flexible board for inputting a driving signal respectively to the drive circuit and the actuator when driving the actuator for ejecting a liquid; and a thermistor provided between the first input line and the second input line, wherein the thermistor has a first resistance value with terminals provided therein being in an electrically disconnected state at a first temperature greater than or equal to a predetermined temperature, and having a second resistance value less than the first resistance value with the terminals provided therein being in an electrically connected state at a second temperature less than the predetermined temperature, and wherein the first input line and the second input line are in an electrically disconnected state from each other at the first temperature so as to place the actuator in a condition for being polarized, and the first input line and the second input line are in an electrically connected state with each other via the thermistor at the second temperature so as to place the actuator in a condition for being driven.

3. The liquid ejecting apparatus according to claim 2, wherein the thermistor has the first resistance value due to heat applied when polarizing the actuator and has the second resistance value when inputting the driving signal to the drive circuit and the actuator for ejecting a liquid.

4. The liquid ejecting apparatus according to claim 2, wherein the first input line includes a first high potential input line for inputting a first potential signal to the drive circuit and a first low potential input line for inputting a second potential signal less than the first potential signal, the second input line includes a second high potential input line for inputting a third potential signal to the actuator and a second low potential input line for inputting a fourth potential signal less than the third potential signal, and the thermistor is provided in at least one of between the first high potential input line and the second high potential input line and between the first low potential input line and the second low potential input line.

5. The liquid ejecting apparatus according to claim 4, wherein a plurality of the thermistors are provided between the first high potential input line and the second high potential input line and between the first low potential input line and the second low potential input line.

6. The liquid ejecting apparatus according to claim 2, wherein the thermistor is provided in the vicinity of the drive circuit.

7. The liquid ejecting apparatus according to claim 2, wherein a plurality of the first input lines and a plurality of the second input lines are provided in both side portions in one direction of the flexible board, respectively.

* * * * *